US009731159B2

(12) United States Patent
Reynolds et al.

(10) Patent No.: US 9,731,159 B2
(45) Date of Patent: Aug. 15, 2017

(54) EXERCISE EQUIPMENT ADAPTER

(71) Applicants: Timothy Reynolds, Red Hook, NY (US); Brian Rettger, Ithaca, NY (US)

(72) Inventors: Timothy Reynolds, Red Hook, NY (US); Brian Rettger, Ithaca, NY (US)

( * ) Notice: Subject to any disclaimer, the term of this patent is extended or adjusted under 35 U.S.C. 154(b) by 0 days.

(21) Appl. No.: 14/954,439

(22) Filed: Nov. 30, 2015

(65) Prior Publication Data

US 2016/0096063 A1 Apr. 7, 2016

Related U.S. Application Data

(63) Continuation-in-part of application No. 14/075,522, filed on Nov. 8, 2013, now abandoned.

(60) Provisional application No. 61/725,022, filed on Nov. 11, 2012.

(51) Int. Cl.

| | |
|---|---|
| ***A63B 21/075*** | (2006.01) |
| ***A63B 21/072*** | (2006.01) |
| ***A63B 21/00*** | (2006.01) |

(52) U.S. Cl.

CPC ..... *A63B 21/0722* (2015.10); *A63B 21/072* (2013.01); *A63B 21/4035* (2015.10); *A63B 21/0726* (2013.01); *A63B 2209/00* (2013.01); *A63B 2225/09* (2013.01); *A63B 2225/093* (2013.01)

(58) Field of Classification Search

CPC . A63B 21/0726; A63B 21/075; A63B 21/072; A63B 2021/0722; A63B 21/0722; A63B 21/4035; A63B 2225/093; A63B 2225/09; A63B 2209/00

See application file for complete search history.

(56) References Cited

U.S. PATENT DOCUMENTS

| | | | | |
|---|---|---|---|---|
| 1,478,706 | A * | 12/1923 | Forker | E05D 3/02 16/381 |
| 8,267,841 | B1 | 9/2012 | Alison et al. | |
| 8,684,889 | B1 * | 4/2014 | Berrisford | A63B 21/0726 482/107 |
| 8,790,380 | B2 | 7/2014 | Buttermann | |
| 8,827,878 | B1 | 9/2014 | Ciminski | |
| 2011/0111929 | A1 * | 5/2011 | Allison | A63B 21/072 482/108 |

(Continued)

FOREIGN PATENT DOCUMENTS

| | | |
|---|---|---|
| CA | 2 807 699 A1 | 8/2013 |

*Primary Examiner* — Sundhara Ganesan
*Assistant Examiner* — Megan Anderson
(74) *Attorney, Agent, or Firm* — Nath, Goldberg & Meyer; Jerald L. Meyer

(57) ABSTRACT

An exercise equipment adapter includes a first enclosure portion having a first divot portion and a second enclosure portion having a second divot portion. A hinge connection connects the first and second enclosure portions, the hinge connection arranging the first enclosure portion and the second enclosure portion in an open configuration and a closed configuration. In the closed configuration, the first enclosure portion and the second enclosure portion are mated to each other, forming an enclosure, and the first and second divot portions forming a cavity. A locking mechanism is configured to lock first enclosure to the second closure in the closed position and a handle is connected to at least one of the first and second enclosure portions.

7 Claims, 15 Drawing Sheets

(56) References Cited

U.S. PATENT DOCUMENTS

| | | | | |
|---|---|---|---|---|
| 2011/0173778 | A1* | 7/2011 | Wales | B25G 3/20<br>16/426 |
| 2012/0252641 | A1 | 10/2012 | Odneal | |
| 2013/0210589 | A1 | 8/2013 | Thompson | |
| 2014/0024506 | A1 | 1/2014 | Vixathep | |
| 2015/0105224 | A1 | 4/2015 | Odneal | |
| 2015/0190672 | A1 | 7/2015 | Rost | |

* cited by examiner

EXERCISE EQUIPMENT ADAPTER

CROSS-REFERENCE TO RELATED APPLICATIONS

This is a continuation in part application that claims priority to U.S. patent application Ser. No. 14/075,522 which claims the benefit of U.S. Provisional Patent Application No. 61/725,022 filed on Nov. 11, 2012, the entire content of which is hereby incorporated by reference.

BACKGROUND

Technical Field

The present disclosure is in the field of exercise and/or body conditioning equipment. More particularly, the present disclosure is directed towards the technical field of adapters for exercise and/or body conditioning equipment. Exercise equipment for which the present adapter is useful includes, without limitation, dumbbells, barbells, home gym equipment, etc. Utilization for which the present exercise equipment adapter is useful includes, without limitation, using the adapter with a dumbbell to assist in kettlebell-like activities, etc.

Description of the Related Art

Past efforts have led to various disclosures directed toward adjustable exercise devices, but the previous disclosures are deficient in several respects. For example, in U.S. Pat. No. 8,267,841 to Allison et al., the inventors disclose a design that attempts to function as both a dumbbell and a kettlebell. The design involves an upper body and a lower body that allows a handlebar of a dumbbell to be placed inside the members, and locked into place via spring locks and a pin that is located on the outside of the aforementioned members.

However, in Allison et al.'s design, the upper and lower bodies are connected only by the locking mechanism, thus relying solely on the secure locking mechanism to ensure the handle bar of the dumbbell does not become dislodged while in use. In addition, the downward force of gravity and inertial forces during movement are directed entirely through the locking mechanism. These aspects of the inventor's design increase risk of injury for the user of the design. Finally, the inventor's design is solely for dumbbell use. Accordingly, there is a need for a safer, more secure and more versatile exercise equipment adapter.

BRIEF SUMMARY

An aspect of the present subject matter is directed to an exercise equipment adapter, comprising: a first enclosure portion comprising a first divot portion; a second enclosure portion comprising a second divot portion; a hinge connection connecting the first and second enclosure portions, the hinge connection arranging the first enclosure portion and the second enclosure portion in an open configuration and a closed configuration, whereby, in the closed configuration, the first enclosure portion and the second enclosure portion are mated to each other, forming an enclosure, and the first and second divot portions forming a cavity; a locking mechanism configured to lock first enclosure to the second closure in the closed position; and a handle connected to at least one of the first and second enclosure portions.

Another aspect of the present subject matter is directed to an exercise equipment adapter, comprising: a first enclosure portion comprising a first top end, a first bottom end and a first transverse divot portion; a second enclosure portion comprising a second top end, a second bottom end, a second transverse divot portion; a hinge connection connecting the first bottom end and the second bottom end, the hinge connection arranging the first enclosure portion and the second enclosure portion in an open configuration and a closed configuration, whereby, in the closed configuration, the first enclosure portion and the second enclosure portion are mated to each other, and the first and second transverse divot portions form a transverse cavity; a locking mechanism configured to lock the first top end to the second top end in the closed position; and a handle connected to at least the first top end to the second top end.

A further aspect of the present subject matter is directed to an exercise equipment adapter, comprising: a first enclosure portion comprising a first top end, a first side end, and a first divot portion, the first divot portion comprising a narrow portion and a wide portion; a second enclosure portion comprising a second top end, a corresponding first side, and a second divot portion, the second divot portion having a corresponding narrow portion and a corresponding wide portion; a vertical hinge connection connecting the first side to the corresponding first side, the hinge connection arranging the first enclosure portion and the second enclosure portion in an open configuration and a closed configuration, whereby the first enclosure portion and the second enclosure portion are mated to each other in the closed position, forming an enclosure and a cavity, the cavity formed by the first and second divot portions, the narrow portion and the corresponding narrow portion forming a narrow opening at a bottom of the enclosure, and the wide portion and the corresponding wide portion forming a wide cavity in a middle portion of the enclosure; a locking mechanism configured to lock the first and second enclosures in the closed position; and a handle connected to at least one of the top end and the second top end.

Yet another aspect of the present subject matter is directed to an exercise equipment adapter comprising a first enclosure portion having a first top end, a first bottom end and a first transverse divot portion and a second enclosure portion having a second top end, a second bottom end, a second transverse divot portion. A threaded hinge connection is disposed on the first bottom end and the second bottom end to provide an open and closed configuration, whereby, in the closed configuration, the first and second transverse divot portions form a transverse cavity. The first top end and the second top end each include a vertical wall perpendicular to the first transverse divot portion and the second transverse divot portion, respectively. The vertical wall has at least two embossments on opposing ends of the vertical wall, whereby, in the closed configuration, the embossments of each vertical wall align and abut to provide a secure connection. The exercise adapter further includes a pair of half-cylinder inserts removably attached between the first and second divot portions in the transverse cavity. The exercise equipment adapter further comprises a U-shaped attachment plane perpendicular to the vertical wall of the first and second top end, wherein the attachment plane of the first top end is configured to overlap the attachment plane of the second top end.

BRIEF DESCRIPTION OF THE DRAWINGS

Many aspects of the disclosure can be better understood with reference to the following drawings, wherein.

DETAILED DESCRIPTION OF THE SUBJECT MATTER

Figure 1:
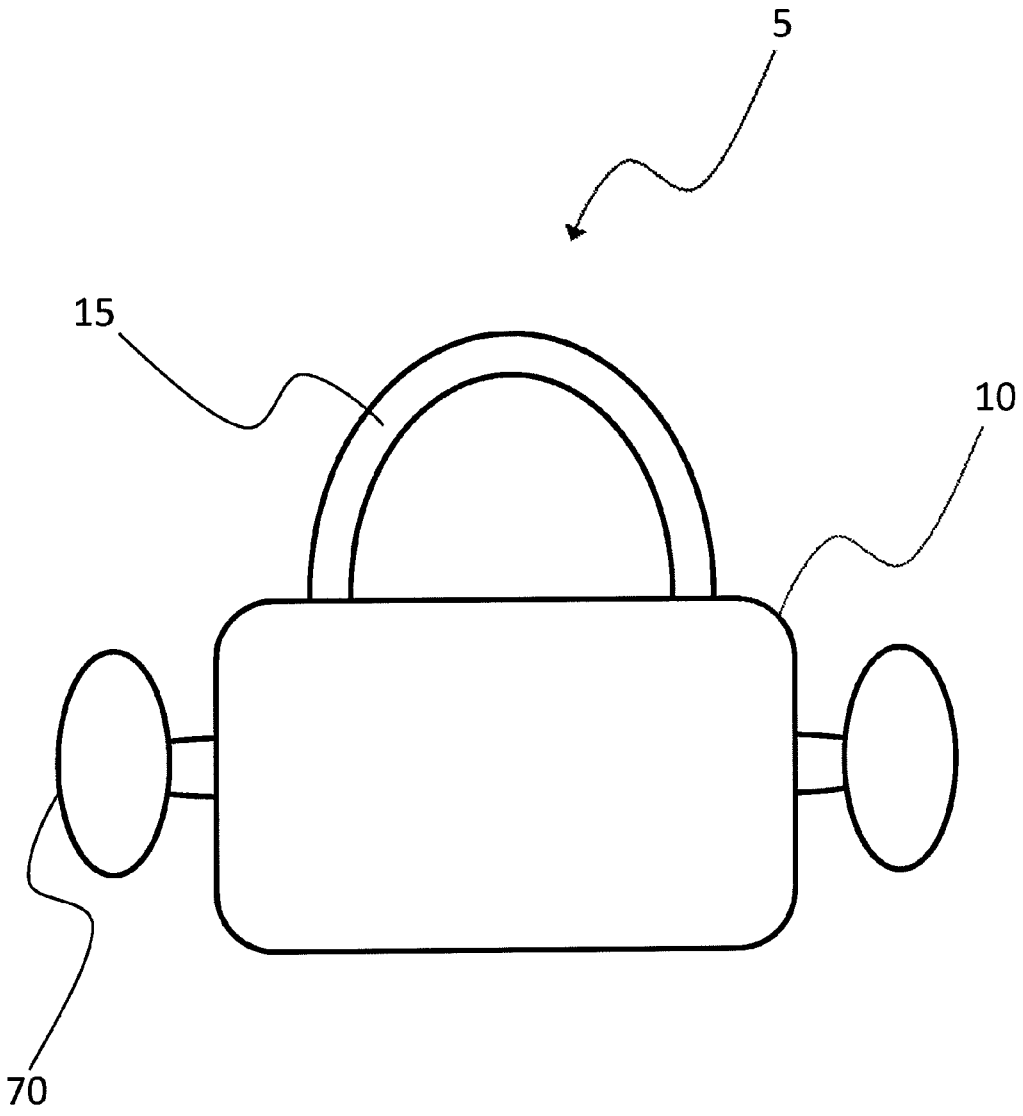
FIG. 1 is a non-limiting exemplary embodiment of an exercise equipment adapter.

Reference is now made in detail to the description of non-limiting embodiments as illustrated in the drawings. While the embodiments described may use specific materials or configurations, there is no intent to limit the subject matter to the embodiment or embodiments disclosed herein. Accordingly, various modifications to the embodiments presented may be readily apparent to those skilled in the art, and the generic principles described herein can be applied to other non-limiting embodiments without departing from the spirit or scope of the claimed subject matter. As such, this detailed description of various alternative embodiments should not be construed to limit the scope or breadth of the present apparatus, system and method as set forth in the claims.

Shown in FIG. 1 is a non-limiting exemplary embodiment of an exercise equipment adapter 5 for adapting use of an existing piece of exercise equipment 70. Exercise equipment adapter 5 comprises an enclosure 10 in which exercise equipment 70 may be secured and a handle 15 allowing for exercise equipment adapter 5 to be used to engage in physical activity, such as kettlebell-like activities, etc.

Figure 2:
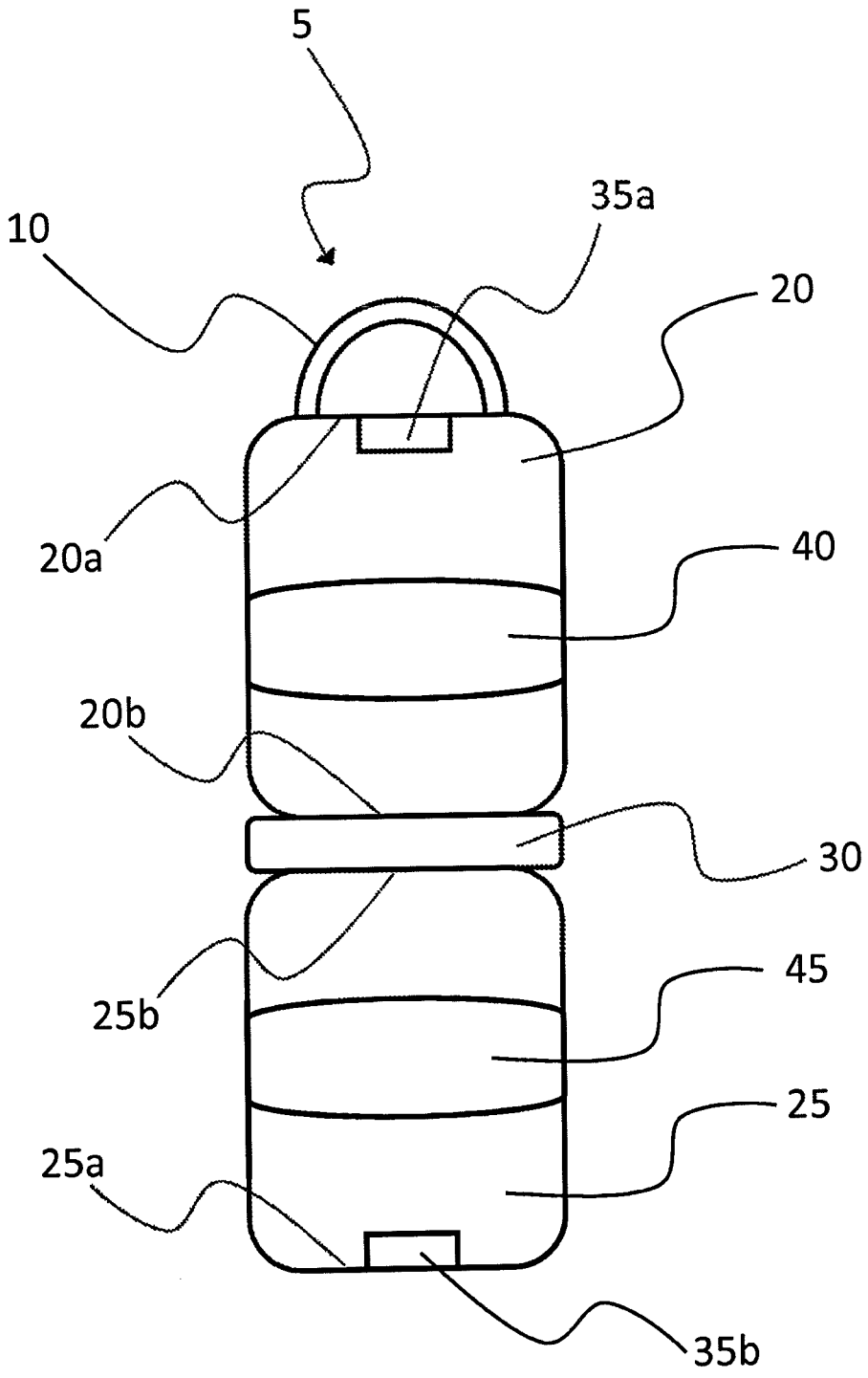
FIG. 2 is a plan view of the exercise equipment adapter in the open configuration.
Figure 3:
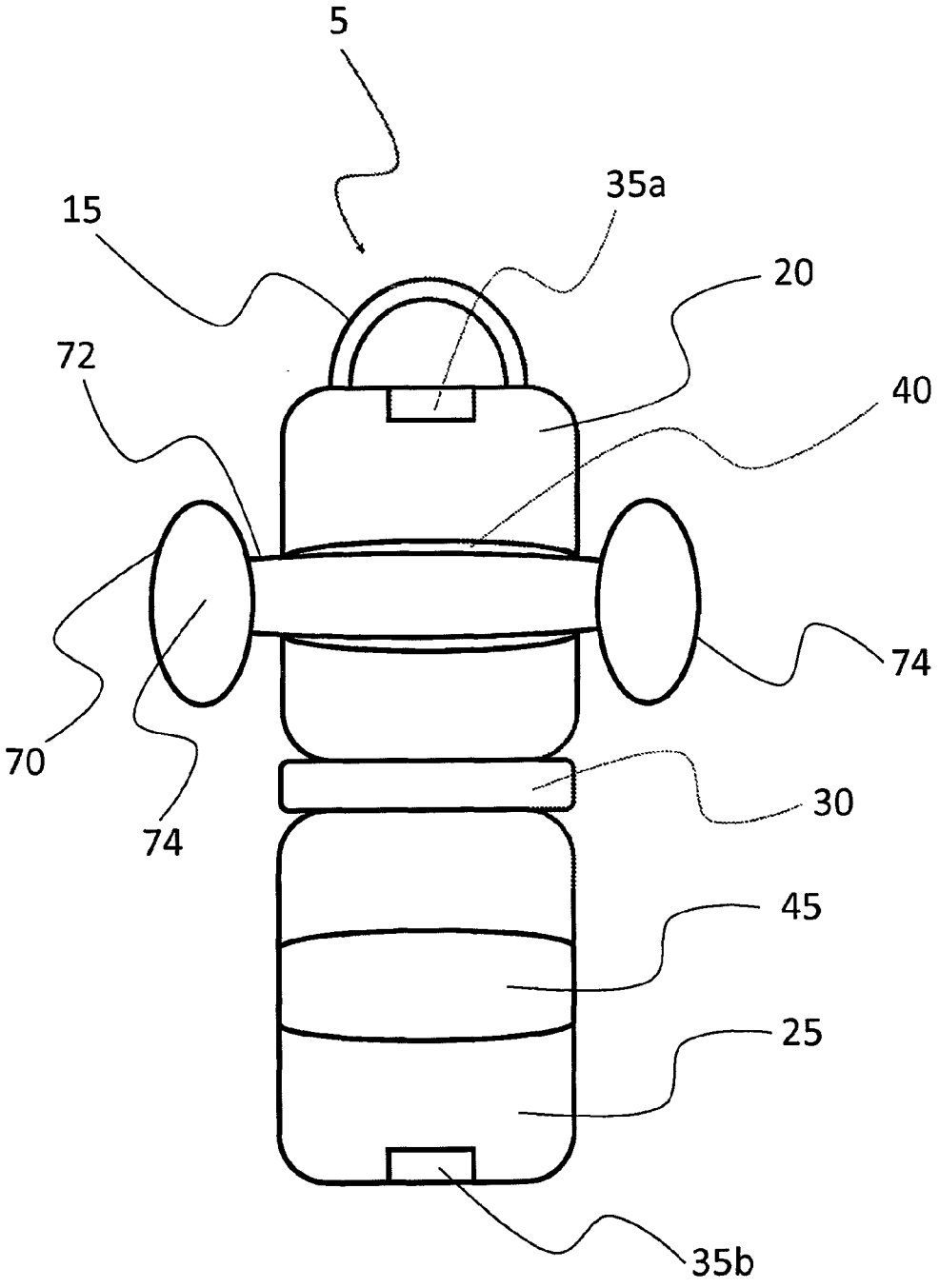
FIG. 3 is a plan view of the exercise equipment adapter in an open configuration with a piece of exercise equipment positioned horizontally in a first transverse divot portion.

Shown in FIGS. 2-3 is a plan view of the non-limiting exemplary embodiment of exercise equipment adapter 5 shown an open configuration. As shown, exercise equipment adapter 5 comprises a first enclosure portion 20 which includes a first top end 20*a*, a first bottom end 20*b* and a first transverse divot portion 40. A second enclosure portion 25 is provided, and includes a second top end 25*a*, a second bottom end 25*b*, and a second transverse divot portion 45.

Figure 4:
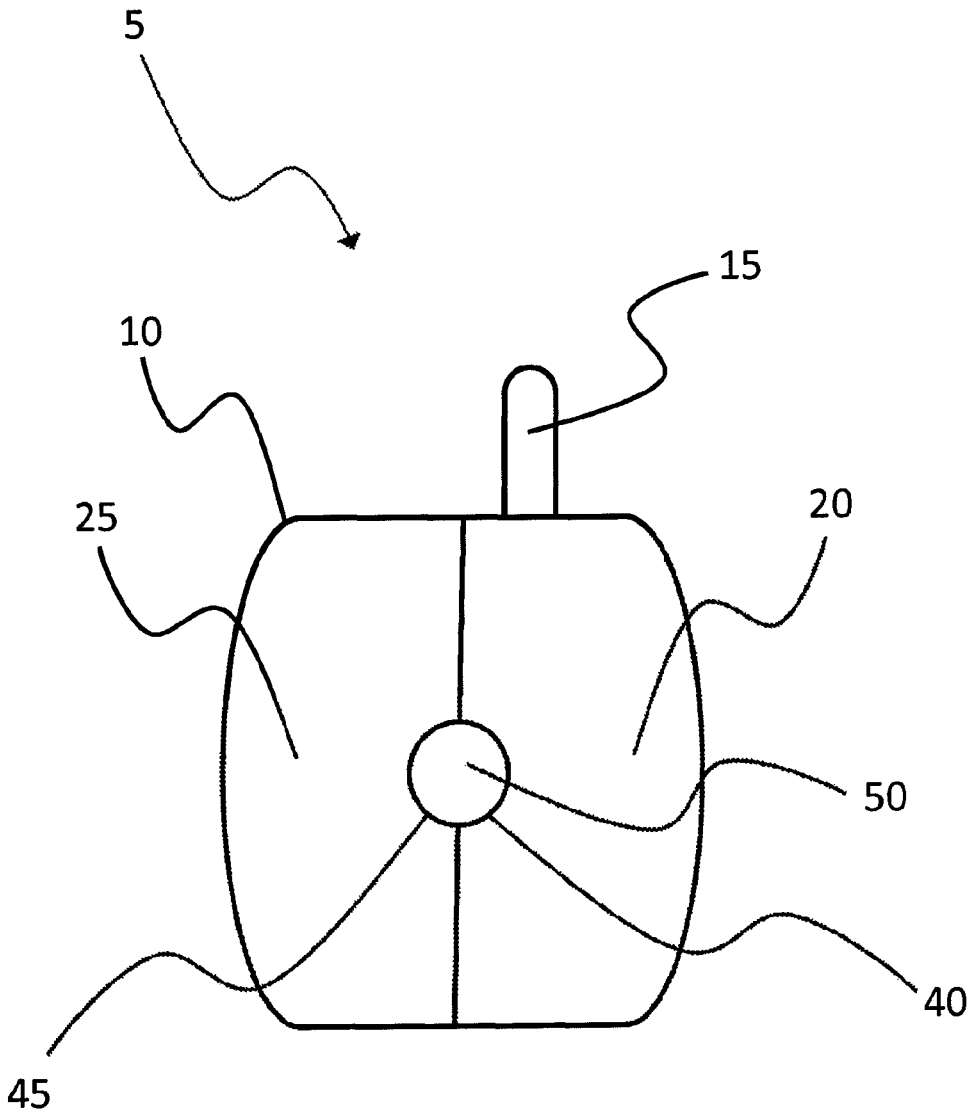
FIG. 4 is a side view of the exercise equipment adapter in a closed configuration, forming an enclosure with a transverse cavity.
Figure 5:
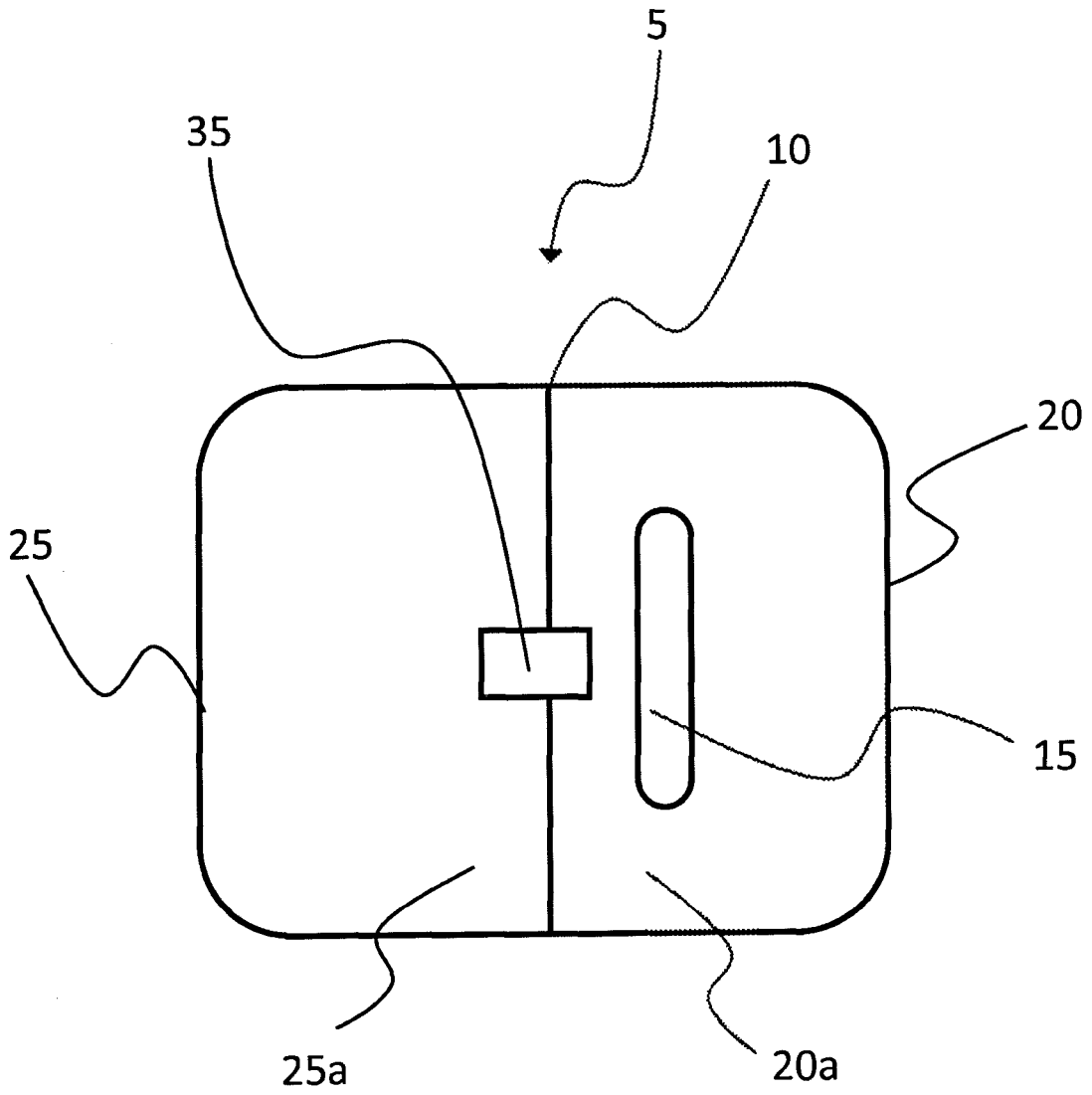
FIG. 5 is a top view of the exercise equipment adapter in the closed configuration.

A hinge connection 30 connects first bottom end 20*b* and second bottom end 25*b* in a horizontal configuration. Hinge connection 30 provides for arranging first enclosure portion 20 and second enclosure portion 25 in an open configuration (FIGS. 2-3), and a closed configuration (FIGS. 4-5). A locking mechanism 35 comprising mating portions 35*a*, 35*b* is configured to lock or mate first top end 20*a* to second top end 25*a* in the closed position. Handle 10 is shown as connected to first enclosure portion 20, but need only be connected to at least one of first top end 20*a* of first enclosure 20 and second top end 25*a* of second enclosure 25.

As shown in FIG. 3, first transverse divot portion 40 is configured to support a handle portion 72 situated between ends weights 74. Second transverse divot portion 45 is similarly configured, thus in the closed position, handle portion 72 is secured between first transverse divot portion 40 and second transverse divot portion 45. In addition to the non-limiting exemplary embodiment shown, first transverse divot portion 40 and second transverse divot portion 45 may vary in width and size to adapt to various handles of exercise and/or body conditioning equipment.

FIG. 4 shows a side view of exercise equipment adapter 5 in the closed configuration. First enclosure portion 20 and second enclosure portion 25 are mated to form enclosure 10. A transverse cavity 50 is formed by first transverse divot 40 and second transverse divot 45. Transverse cavity 50 is used to secure handle portion 72 of exercise equipment 70.

FIG. 5 shows a top view of exercise equipment adapter 5, where first enclosure portion 20 is mated to second enclosure portion 25 in the closed configuration. Locking mechanism 35 locks together first top end 20*a* of first enclosure portion 20 and second top end 25*a* of second enclosure portion 25 to form enclosure 10. In this exemplary embodiment, handle 15 is attached to first enclosure 20.

As depicted in the non-limiting exemplary embodiment shown in FIGS. 1-5, exercise equipment adapter 5 may be utilized with any existing exercise and/or body conditioning equipment 70 comprising a transverse handle bar 72 between two end weights 74, as well as other forms of exercise and/or body conditioning equipment comprising a similar configuration that allows for rigid and secure fastening of an exercise equipment adapter 5.

First and second enclosures 20, 25 may be manufactured from strong, durable materials. By way of non-limiting example, materials from which first and second enclosure portions 20, 25 are manufactured from includes: plastic, rubber, metal, steel, iron, etc. The shape and configuration of first and second enclosure portions 20, 25 may vary from the non-limiting embodiment shown to accommodate different uses or applications. In particular, widths of first and second enclosure portions 20, 25 may vary, including, by way of non-limiting example, being 3-6 inches in width in order to securely attach to transverse handle portion 72, yet still fit between weighted ends 74 of exercise and/or body conditioning equipment 70, or to accommodate different uses or applications.

Handle 15 may have a shape that is square, circular, rectangular, curved, triangular or of other manner of geometric shape. By way of non-limiting example, the width handle 15 may be 6-12 inches in width in order to accommodate different hand sizes and applications or use of the device. Additionally, the width of handle 15 may be wide enough to accommodate either single or double hand-grasp of the handle simultaneously. The height between the top of handle 15 and enclosure 10 may also vary in height, by way of non-limiting example, from 3-6 inches as to accommodate different uses or applications. Additionally, handle 15 may be attached to either first enclosure portion 20 or second enclosure 25.

By way of non-limiting example, locking mechanism 35 may include any of the following descriptions of locking devices or other such mechanism that support the desired mating of first and second enclosure portions. Locking mechanism 35 may comprise mating portion 35*a* attached to first enclosure portion 20 and corresponding mating portion 35*b* attached to second enclosure portion 25. Another example of locking mechanism 35 include the joining of a male piece attached to one of first and second enclosure portions 20, 25 and a corresponding female piece attached to the other of first and second enclosure portion 20, 25, which may then be locked into place with a corresponding male and female bolt or other locking system.

By way of additional non-limiting example, the male portion may be an extension of the enclosure that projects or protrudes off either first enclosure portion 20 or second enclosure portion 25. Such a projection may or may not be made of the same material as the enclosure itself, and may or may not be attached via a fastener, as necessary by the application. A corresponding female portion may comprise an indentation on the other of the first enclosure portion 20 and second enclosure portion 25 which is configured to allow for the male portion to fit securely. The shape of the enclosure may vary from the figure shown to accommodate different methods of uses or applications.

An additional non-limiting example of locking mechanism 35 includes a spring loaded button or other device that may engages once first enclosure portion 20 is mated with second enclosure portion 25 in the closed position, forming enclosure 10. In such an exemplary embodiment, depressing the button or device, or other methods, may unload springs or other components, thus allowing enclosure 10 to be unmated, unlatched, or unlocked.

In addition to the above examples, numerous other examples for use in exercise equipment adapter 5 include, but are not exclusive to: clamp, push pin, button, strap, bolt, screw, hook, clasp, buckle, spring, or any combination of the previously mentioned items. Additional or multiple locking mechanisms 35 may be included in exercise equipment adapter 5 if required. Materials from which locking mechanism 35, including mating portions 35*a*, 35*b*, may be manufactured includes, without limitation, plastic, rubber, metal, steel, iron, etc.

Figure 6:
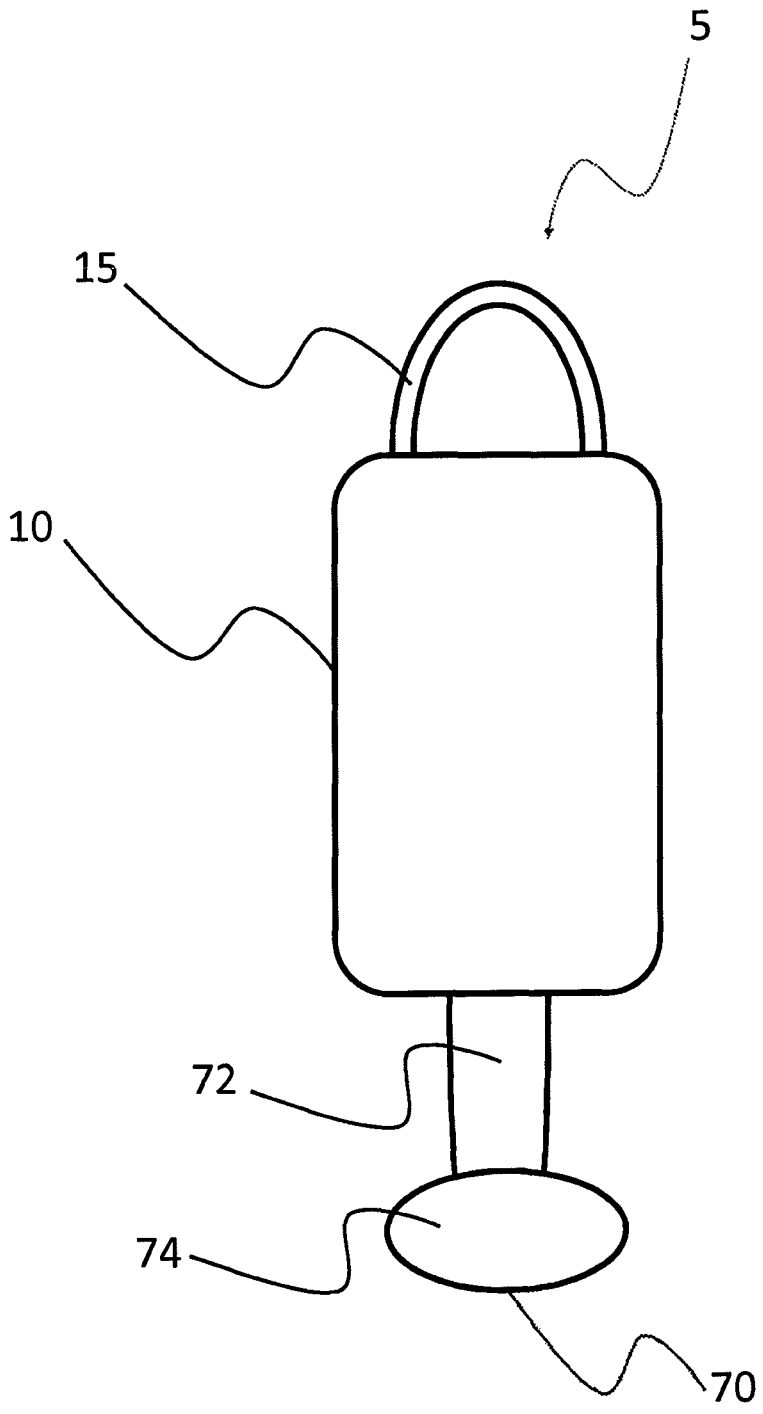
FIG. 6 is a non-limiting exemplary embodiment of an exercise equipment adapter.

Shown in FIG. 6 is another non-limiting exemplary embodiment of exercise equipment adapter 5, wherein exercise equipment 70 is arranged vertically, with one of two weight ends 74 contained within enclosure 10. For convenience, in the description of FIGS. 6-9, common reference numerals are used, accordingly, previous descriptions should be referred to if not specifically addressed.

Figure 7:
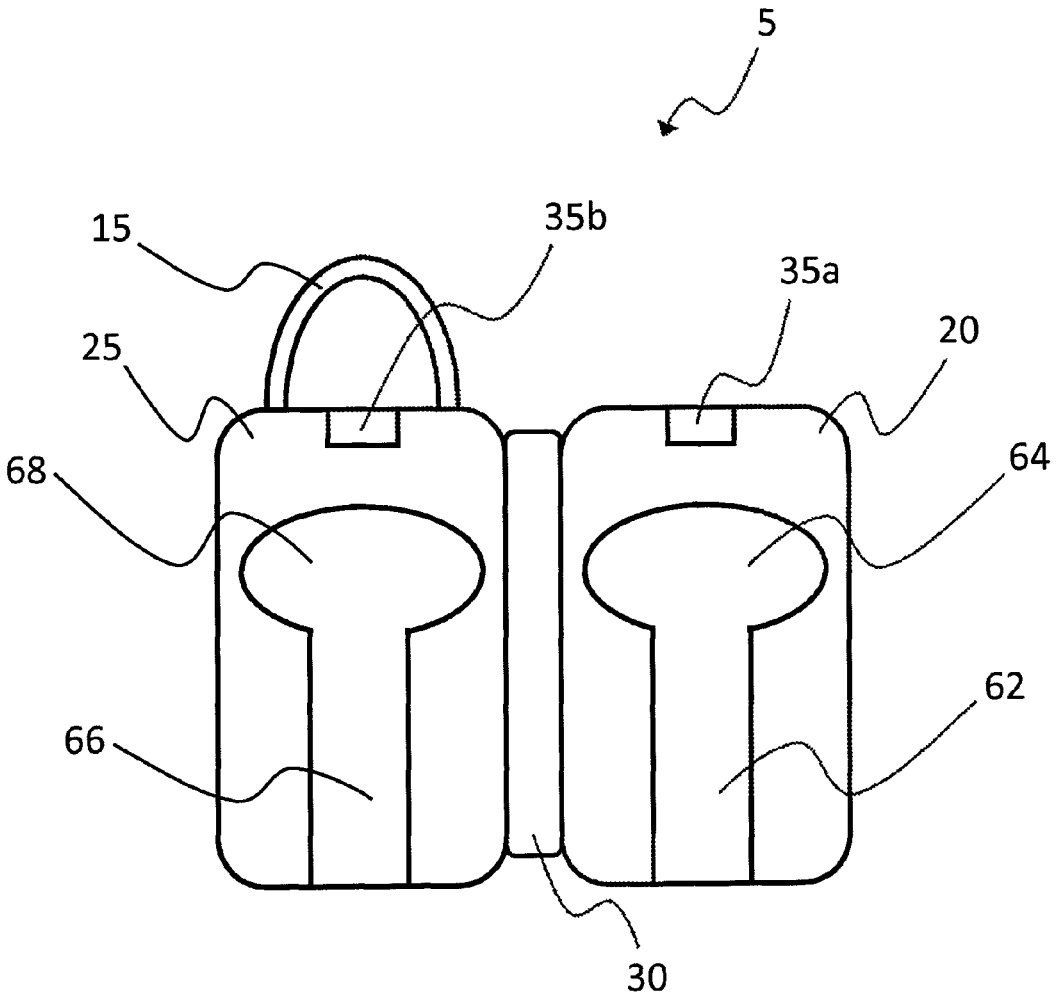
FIG. 7 is a plan view of the exercise equipment adapter in the open configuration.

FIG. 7 is a plan view of exercise equipment adapter 5 in an open configuration. As shown in this exemplary embodiment, first enclosure portion 20 comprises a narrow cavity portion 62 and a wide cavity portion 64. Second enclosure portion 25 comprises a corresponding narrow cavity portion 66 and a corresponding wide cavity portion 68. Hinge connection 30 is vertically configured between first enclosure portion 20 and second enclosure portion 25 in a side-by-side configuration. Locking mechanism 35 comprising mating portion 35*a* on first enclosure portion 20 and mating portion 35*b* on second enclosure portion 25 are provided to secure exercise equipment adapter 5 in a closed position.

Figure 8:
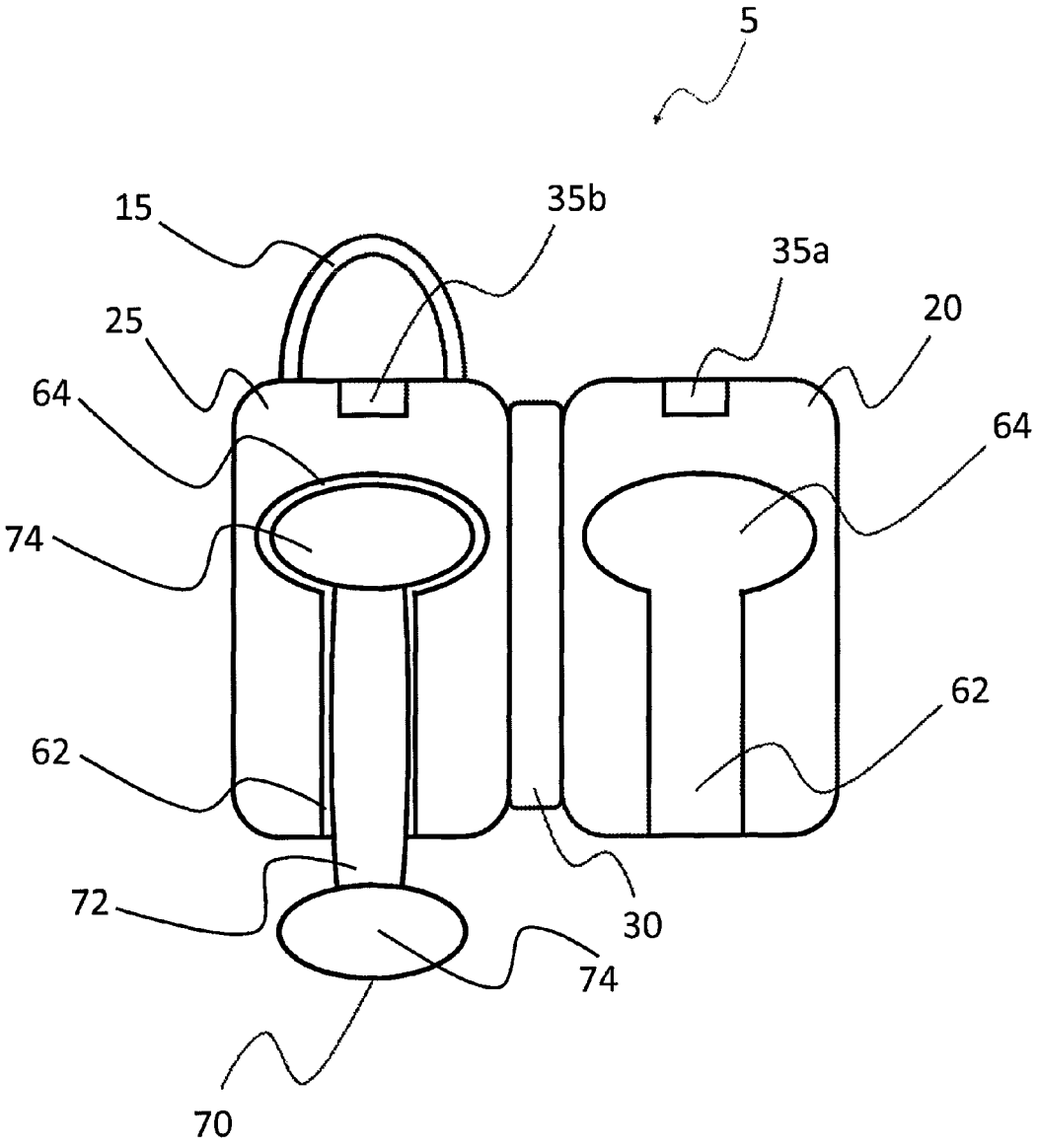
FIG. 8 is a plan view of the exercise equipment adapter in an open configuration with a piece of exercise equipment positioned vertically in a cavity.

FIG. 8 is a plan view of the exercise equipment adapter in the open configuration showing exercise equipment 70 vertically positioned in second enclosure 25. As shown, narrow cavity portion 66 is configured to support handle portion 72 and wide cavity portion 68 is configured to support one of end weights 74, leaving the other end weight 74 outside of second enclosure portion 25. Corresponding narrow cavity portion 62 and wide cavity portion 64 are similarly configured.

Figure 9:
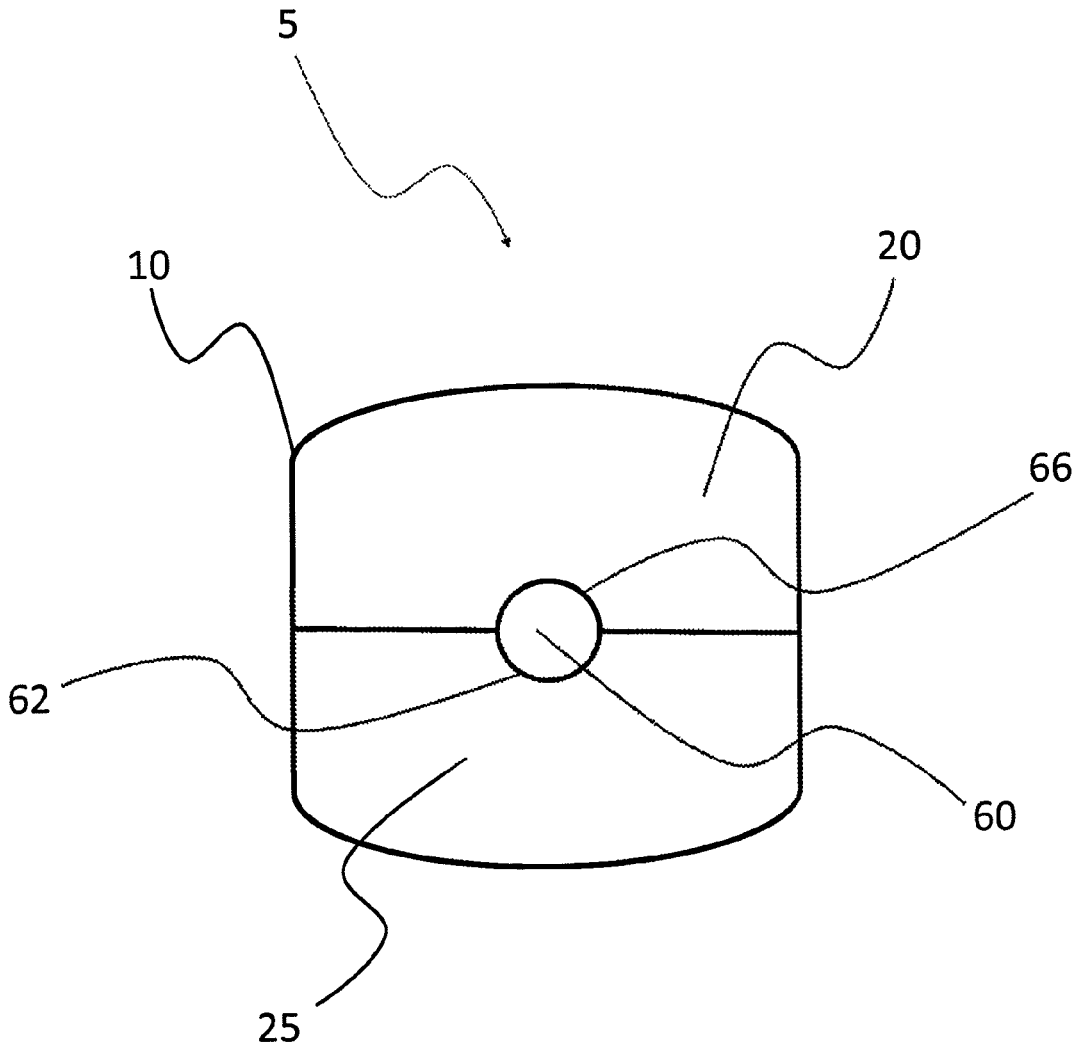
FIG. 9 is a bottom view of the exercise adapter in the closed position.

FIG. 9 is a bottom view of exercise equipment adapter 5 in the closed position. As shown, narrow cavity portions 62 or first enclosure portion 20 and corresponding narrow cavity portion 66 of second enclosure portion form a cavity 60 in enclosure 10.

Similar to the non-limiting embodiment shown in FIGS. 1-5, various sizes, widths, and other dimensions of first and second enclosure portions 20, 25, narrow and wide cavity portions 62, 64, 66, 68, and handle 15 may employed for exercise equipment adapter 5 in order to accommodate different uses or applications.

All above examples are not exclusive embodiments and methods and may be modified dependent upon the design applications. In the configurations of the exemplary embodiments shown, hinge connection 30 and locking mechanism 35 are relied upon to support mating, locking, and securing of first enclosure portion 20 with second enclosure portion 25. The physical structures of first enclosure portion 20 and second enclosure portion 25 support the weight and inertia of the piece of exercise equipment 70. Accordingly, hinge connection 30 and locking mechanism 35 are significantly stressed by the weight of exercise equipment 70 supported therein.

Figure 10:
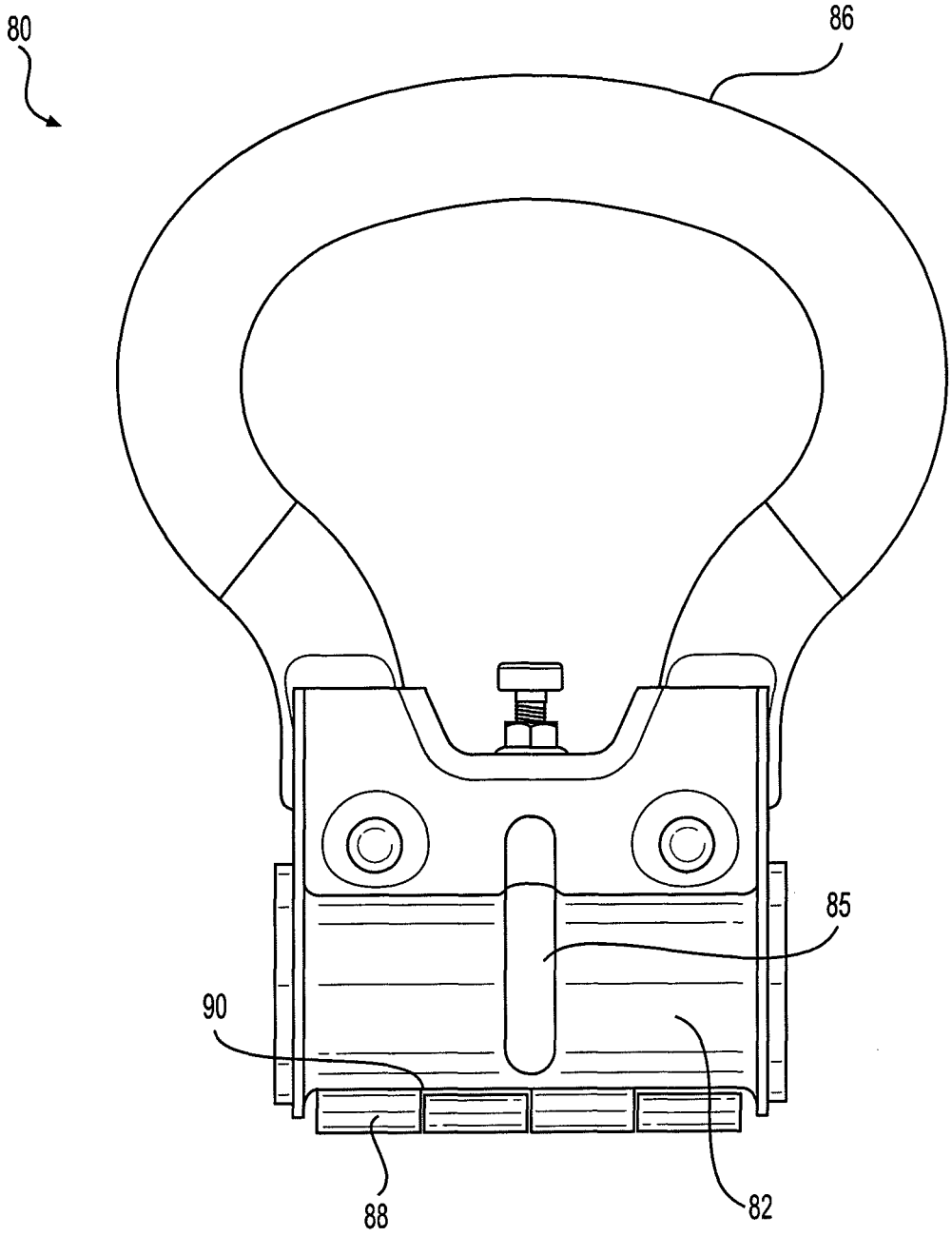
FIG. 10 is a front view of the exercise equipment adapter in the closed configuration according to another embodiment of the present subject matter.
Figure 12:
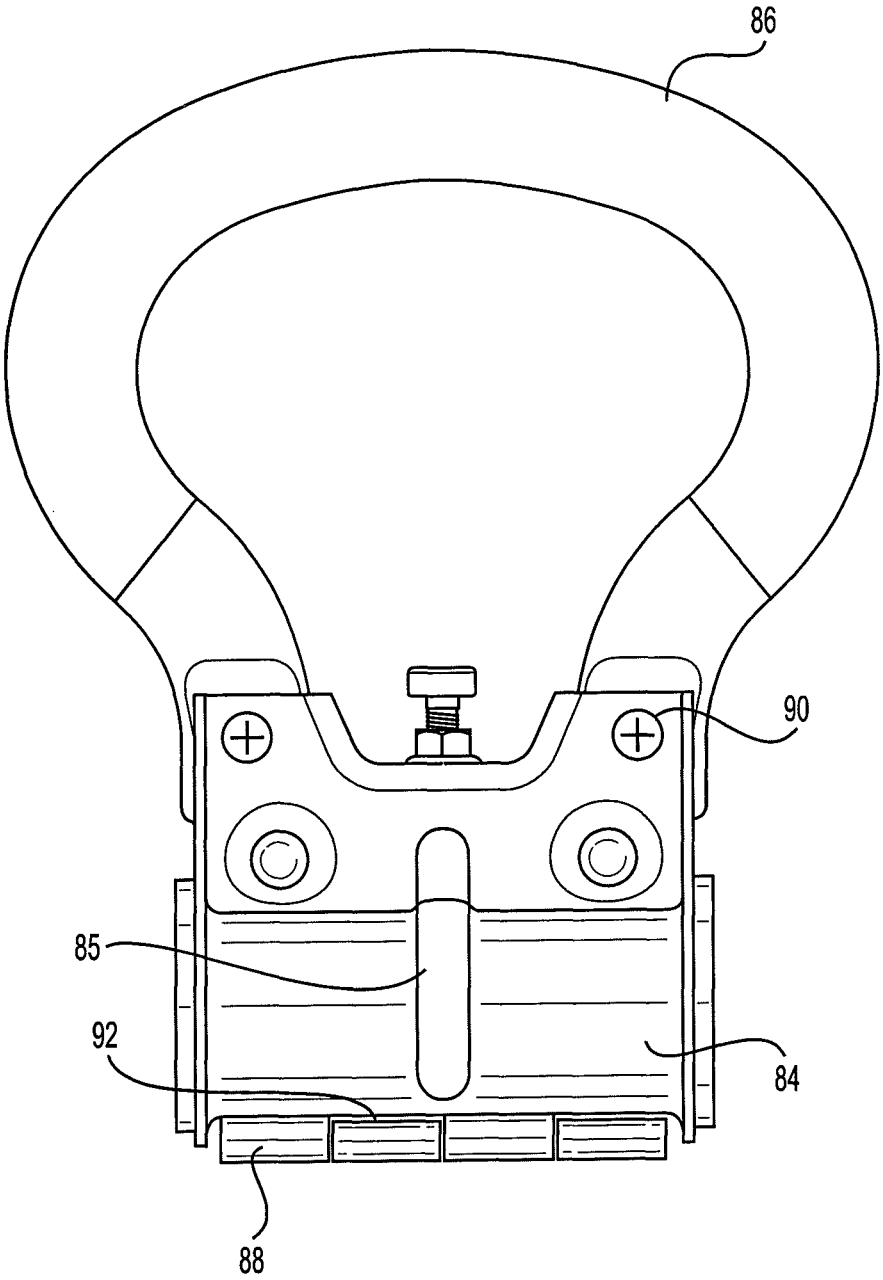
FIG. 12 is a rear view of the exercise equipment adapter in the closed configuration according to another embodiment.

FIGS. 10 and 12 show front and rear views of another exemplary embodiment of the exercise equipment adapter 80, respectively. According to this embodiment, the exercise equipment adapter 80 includes three main components that comprise the body of the exercise equipment adapter 80: the first enclosure portion 82, the second enclosure portion 84 and the handle 86. Both the first enclosure portion 82 and the second enclosure portion 84 include threaded hinge connections 88 which are disposed on the first bottom end 90 and the second bottom end 92, respectively. The hinge connection 88 provides a threaded cylindrical body adapted to receive a retaining pin. The threaded hinge connection 88 on the first bottom end 90 and the second bottom end 92 may be provided in an alternating arrangement such that when the first enclosure portion 82 and the second enclosure portion 84 are aligned, the hinge connection 88 forms an uninterrupted straight channel to receive a retaining pin therein. The hinge connection 88 arranges the first enclosure portion 82 and the second enclosure portion 84 in an open configuration and a closed configuration.

The first enclosure portion 82 and the second enclosure portion 84 each include corresponding gusset portions 85 along the center thereof. The gusset portions 85 are concentric with the barbell clamping area formed by the first and second enclosure portions 82, 84. The second enclosure portion 84 further includes at least two mounting apertures 90. The mounting apertures 90 are configured to receive a fastener, such as a screw, nut, etc. The fastener removably attaches the handle 86 to the second enclosure portion 84. In a closed configuration, the handle 86 is sandwiched between the top ends of the first enclosure portion 82 and the second enclosure portion 84. The handle 86 is fixed on the second enclosure portion 84 in both the open and closed configuration such that the handle 86 is incapable of being pivoted or rotated.

Figure 11:
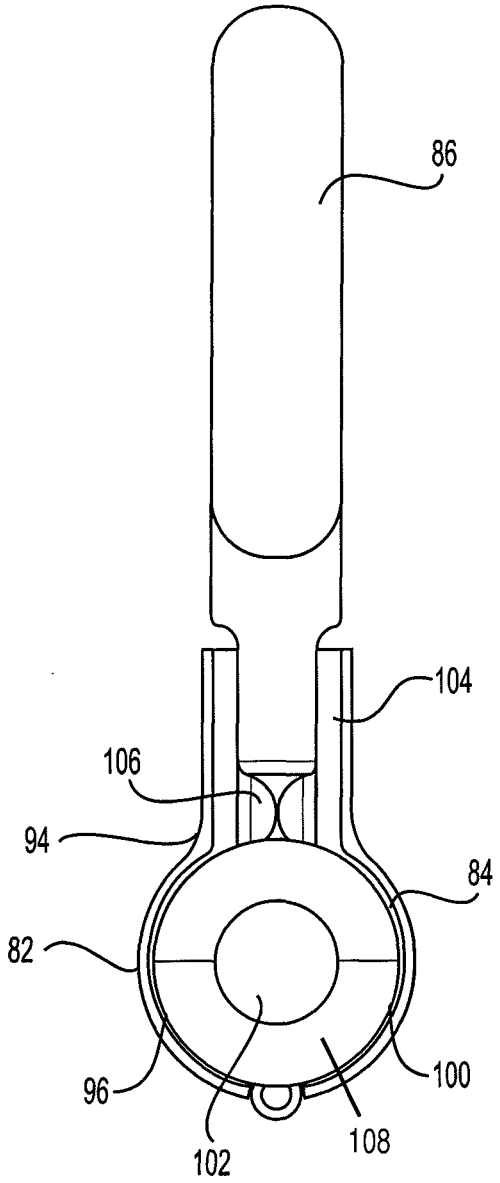
FIG. 11 is a side view of the exercise equipment adapter with barbell inserts in the closed configuration according to another embodiment.
Figure 13:
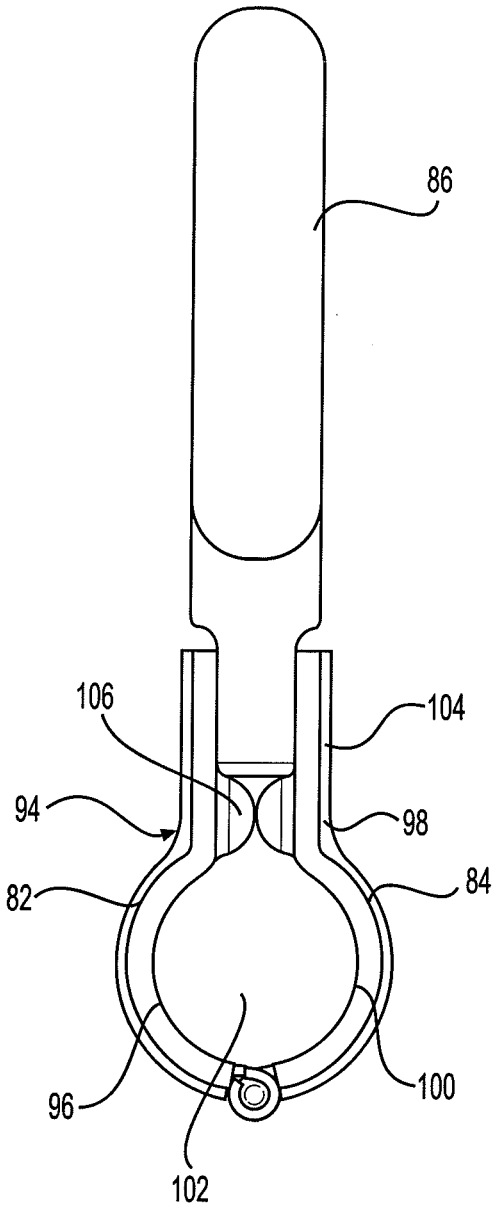
FIG. 13 is a side view of the exercise equipment adapter in the closed configuration according to another embodiment.

FIGS. 11 and 13 show side perspective views of the front and rear views shown in FIGS. 10 and 12, respectively. As described above, in the closed configuration, the handle 86 is sandwiched between the first enclosure portion 82 and the second enclosure portion 84. The first enclosure portion 82 further comprises a first top end 94 and a first transverse divot portion 96 and the second enclosure portion 84 comprises a second top end 98 and a second transverse divot portion 100. In the closed configuration, the first and second transverse divot portions 96, 100 form a transverse cavity 102. The first top end 94 and second top end 98 of each enclosure portion comprises a vertical wall 104 perpendicular to the each transverse divot portion 86, 100. The vertical wall 104 comprises at least two embossments 106 on each end of the vertical wall. The embossments 106 of each vertical wall 104 align and abut in the closed configuration, as shown in FIGS. 11 and 13. The embossments 106 are circular nodules extending outwardly from the vertical wall 104. The embossments 106 increase the enclosure's stiffness, rigidity and durability by adding a contact surface. The handle portion 86 rests above the embossments 106 and are wedged between the vertical walls 104 in a similar manner.

Figure 14:
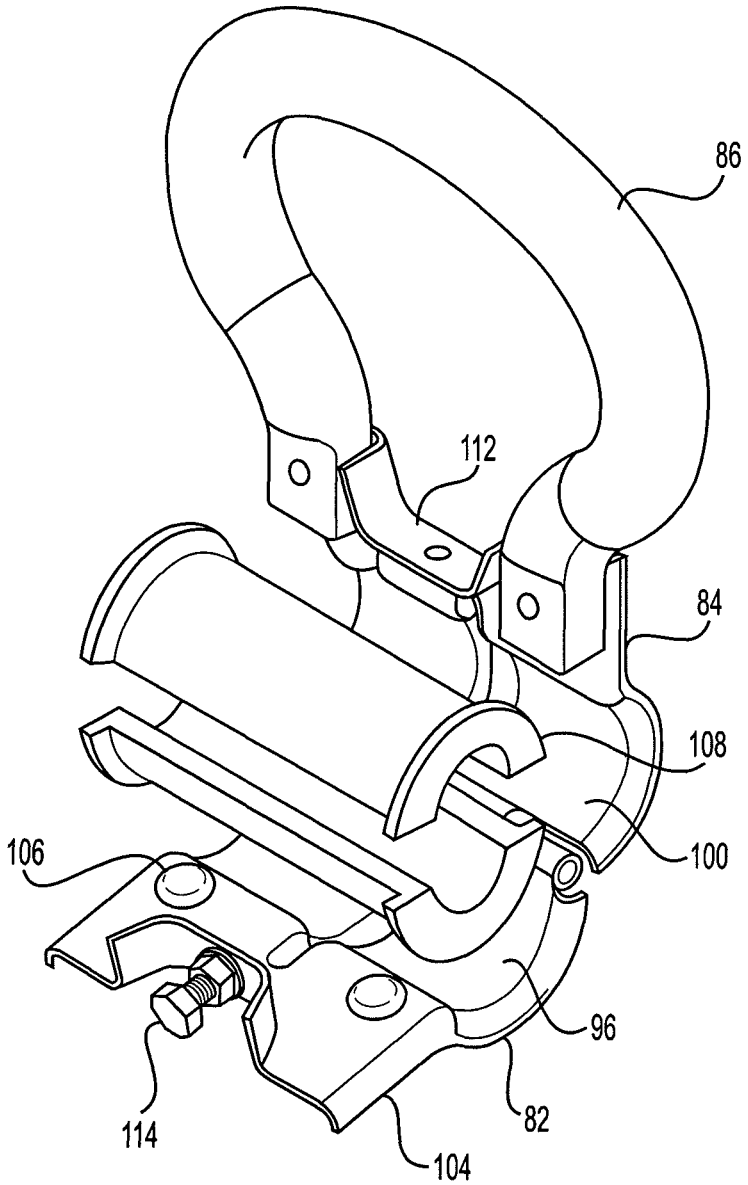
FIG. 14 is a perspective view of the exercise equipment adapter in an open configuration.
Figure 15:
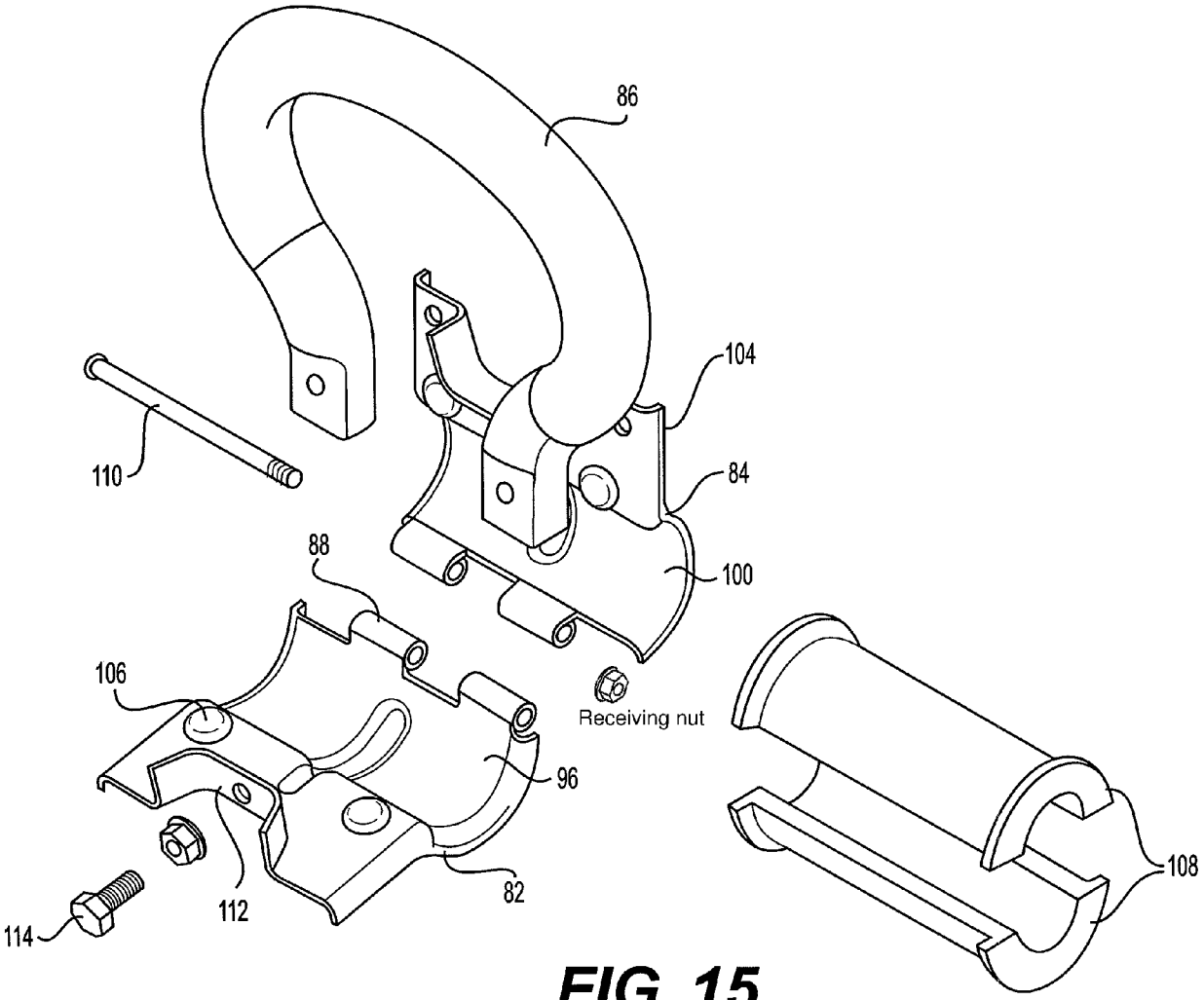
FIG. 15 is an exploded view of the exercise equipment adapter according another embodiment.

Referring now to FIGS. 14 and 15, there are shown further exemplary embodiments of the present subject matter. In this particular non-limiting embodiment, the exercise equipment adapter 80 further includes a pair of half-cylinder inserts 108. The half-cylinder inserts 108 are designed to be used in pairs such that they enclose a barbell handle therein. In some embodiments, when the clamping area formed by the transverse divot portions of the first enclosure portion 82 and the second enclosure portion 84 is too large to firmly hold a barbell therein, the half-cylinder inserts 108 are provided. The half-cylinder inserts 108 are removably attached between the first and second divot portions 96, 100. The diameter of the half-cylinder inserts 108 must be smaller than the transverse cavity formed by the first and second enclosure portions 82, 84. The half-cylinder inserts may comprise rubber, plastic, or combinations thereof. The half-cylinder inserts 108 are adapted to enclose the shaft of the dumbbells that are smaller in diameter than the transverse cavity formed by the first and second enclosure portions 82, 84. It is contemplated the pair of half-cylinder inserts 108 may be provided in a plurality of sizes to accommodate dumbbells of varying diameters.

In use, the exercise equipment adapter 80 is initially formed by aligning the corresponding hinge connections 88 located at the bottom ends of the first enclosure portion 82 and the second enclosure portion 84. When the threaded hinge connection 88 of each enclosure portion is aligned, a retaining pin 110 is inserted within the hinge connection and threaded until the retaining pin 110 is fully engaged with a receiving nut at a distal end of the hinge connection 88. The half-cylinder inserts 108 may be placed in the transverse cavity 102 formed by the enclosure portions. The handle 86 is removably attached to the second enclosure portion 84 and fixed thereon. Each enclosure portion 84, 86 is pivoted via the hinge connection 108 to provide a closed configuration. In the closed configuration, the transverse divot portions of the first enclosure portion 82 and the second enclosure portion 84 form a transverse cavity which contains the pair of half-cylinder inserts 108 therein. Further, in the closed configuration, the vertical walls 104 at the first top end and second top end of each enclosure portion are parallel. The embossments 106 on the adjacent vertical walls 104 abut and form a seal between the handle 86 and the barbell or half-cylinder inserts 108.

The first top end and second top end further include U-shaped attachment plane 112 perpendicular to the vertical wall 104 of the first and second top end. The attachment plane 112 of the first top end is configured to overlap the attachment plane 112 of the second top end. Each attachment plane 112 comprises an aperture to receive a fastener. The fastener secures each attachment plane 112 to lock the first top end to the second top end in the closed position to form the barbell clamping area. In some embodiments, the fastener is a nut and bolt, although other quick release fasteners are contemplated.

While the foregoing written description of the disclosure enables one of ordinary skill to make and use what is considered presently to be the best mode thereof, those of ordinary skill will understand and appreciate the existence of variations, combinations, and equivalents of the specific embodiment, method, and examples herein. The disclosure should therefore not be limited by the above described embodiment, method, and examples, but by all embodiments and methods within the scope and spirit of the disclosure.

The invention claimed is:

1. An exercise equipment adapter, comprising:

a first enclosure portion comprising a first top end, a first bottom end and a first transverse divot portion;

a second enclosure portion comprising a second top end, a second bottom end, a second transverse divot portion;

a threaded hinge connection disposed on the first bottom end and the second bottom end, the threaded hinge connection arranging the first enclosure portion and the second enclosure portion in an open configuration and a closed configuration, whereby, in the closed configuration, the first and second transverse divot portions form exactly one transverse cavity; and a handle connected to the first top end of the second enclosure portion;

wherein the first top end comprises a vertical wall perpendicular to the first transverse divot portion and the second top end comprises a vertical wall perpendicular to the second transverse divot portion; and each of the vertical walls comprises two embossments on opposing ends of the vertical wall, wherein the embossments of each of the vertical walls align and abut in the closed configuration.

2. The exercise equipment adapter of claim 1, further comprising a U-shaped attachment plane perpendicular to the vertical wall of the first and second top end, wherein the attachment plane of the first top end is configured to overlap the attachment plane of the second top end.

3. The exercise equipment adapter of claim 2, wherein each attachment plane comprises an aperture for receiving a fastener to lock the first enclosure portion and the second enclosure portion in the closed configuration.

4. The exercise equipment adapter of claim 1, wherein the embossments are circular nodules extending outwardly from each of the vertical walls.

5. The exercise equipment adapter of claim 1, further comprising:

a retaining pin;

wherein the threaded hinge connection is configured to receive the retaining pin therein until the retaining pin is engaged with a receiving nut at a distal end of the hinge connection.

6. The exercise equipment adapter of claim 1, further comprising a pair of half-cylinder inserts located between the first and second divot portions, wherein the pair of half-cylinder inserts are adapted to receive a barbell therein.

7. The exercise equipment adapter of claim 1, wherein the first and second enclosure portions comprise corresponding gusset portions along the center thereof, wherein the gusset portions are concentric with the barbell clamping area formed by the first and second enclosure portions.

* * * * *